US006873302B1

(12) United States Patent
Welsh

(10) Patent No.: US 6,873,302 B1
(45) Date of Patent: Mar. 29, 2005

(54) SIGNAL DETECTION ANTENNA

(75) Inventor: Raphael Joseph Welsh, Pasadena, MD (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 10/315,283

(22) Filed: Dec. 9, 2002

(51) Int. Cl.[7] ..... H01Q 21/00; H01Q 7/06
(52) U.S. Cl. ..... 343/867; 343/742; 343/788
(58) Field of Search ..... 343/867, 866, 343/741, 742, 787, 788, 895; H01Q 21/00, 7/06

(56) References Cited

U.S. PATENT DOCUMENTS 2,256,803 A * 9/1941 Hauser ..... 343/788
2,399,382 A 4/1946 Polydoroff
3,031,663 A * 4/1962 Wennerberg ..... 343/788
5,258,766 A * 11/1993 Murdoch ..... 343/742
5,281,941 A 1/1994 Bernstein ..... 336/188
5,835,066 A 11/1998 Kropielnicki et al. ..... 343/704
6,163,305 A 12/2000 Murakami et al. ..... 343/788
6,344,824 B1 * 2/2002 Takasugi et al. ..... 343/700 MS
6,538,616 B1 * 3/2003 Bedard ..... 343/788
6,600,458 B1 * 7/2003 Welsh ..... 343/867

* cited by examiner

*Primary Examiner*—Hoanganh Le
(74) *Attorney, Agent, or Firm*—Baker Botts L.L.P.

(57) ABSTRACT

According to one embodiment of the invention, a signal receiving apparatus is provided. The signal receiving apparatus includes a body. The signal receiving apparatus also includes at least one winding set positioned around the body. Each winding set comprises two or more windings that are electrically coupled to each other and substantially define a corresponding two or more planes. The corresponding two or more planes are substantially parallel to each other.

24 Claims, 4 Drawing Sheets

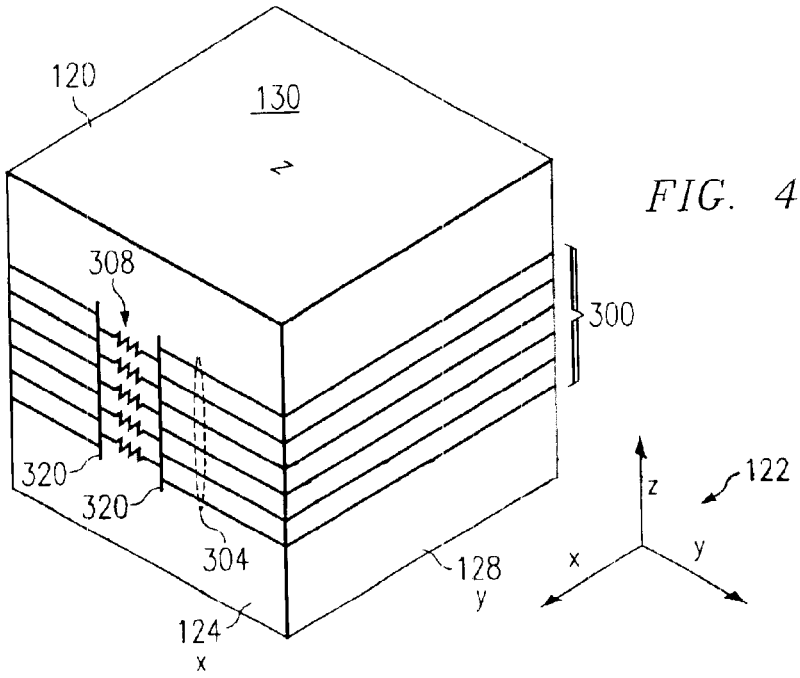
FIG. 4
FIG. 5
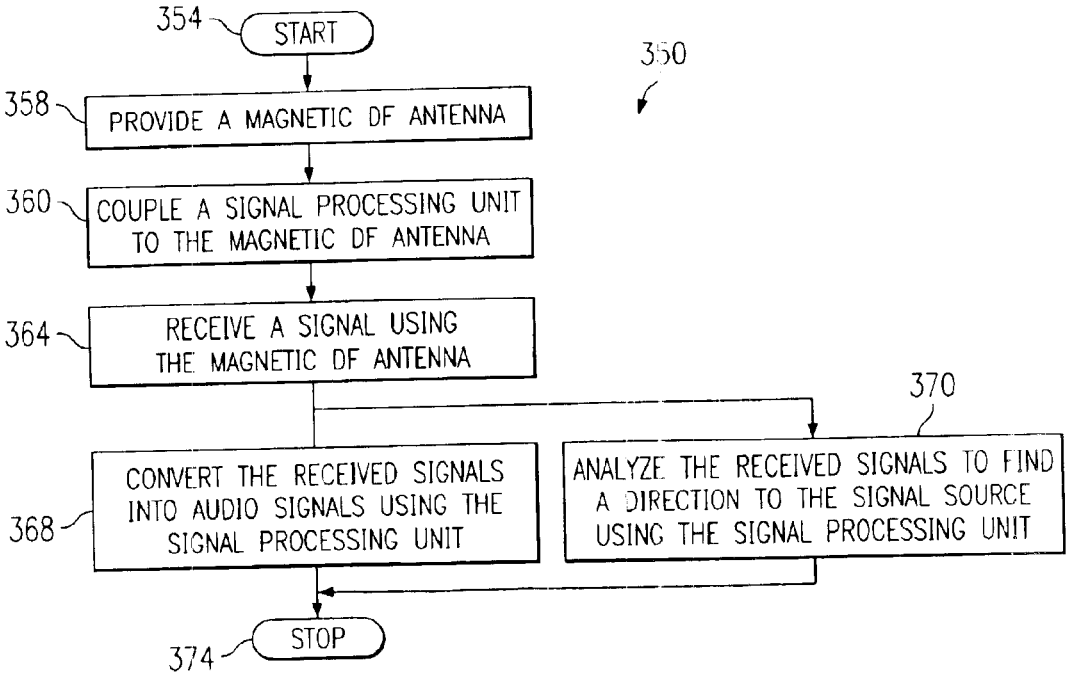

SIGNAL DETECTION ANTENNA

TECHNICAL FIELD OF THE INVENTION

This invention relates generally to electromagnetic signal processing devices and more particularly to a signal detection antenna.

BACKGROUND OF THE INVENTION

Signal intelligence is an integral part of intelligence collection for law enforcement and national security. To effectively intercept transmitted communications signals and find the locations of the transmission, direction finding ("DF") antennas are positioned in strategically selected locations. The criteria for selecting locations for the DF antennas include the range of the signal source, the size and sensitivity of the antenna, and other tactical concerns.

Antennas that are sensitive to the electric field of electromagnetic signals (referred to as "E-field antennas") are commonly used to intercept communications because of their relatively small size and relatively high sensitivity. However, the effectiveness of E-field antennas may be reduced significantly depending on certain external factors. For example, E-field antennas generally need to be positioned on a level ground plane and away from significant man-made structures, natural terrain features, and power emission sources. Additionally, although E-field antennas are relatively small, their physical size may render concealment of the antennas problematic in certain environments. Because of these concerns, E-field antennas may limit the range of tactical options available to a tactician, which adversely affects law enforcement and national security.

SUMMARY OF THE INVENTION

According to one embodiment of the invention, a signal receiving apparatus is provided. The signal receiving apparatus includes a body. The signal receiving apparatus also includes at least one winding set positioned around the body. Each winding set comprises two or more windings that are electrically coupled to each other and substantially define a corresponding two or more planes. The corresponding two or more planes are substantially parallel to each other.

Some embodiments of the invention provide numerous technical advantages. Other embodiments may realize some, none, or all of these advantages. For example, according to one embodiment, the signal sensitivity of a magnetic antenna is increased without increasing the antenna's size by providing multiple windings to form the magnetic antenna. According to another embodiment, some of the tactical concerns associated with the placement of an E-field antenna are eliminated by using a magnetic antenna as a signal detection antenna. According to another embodiment, direction finding operations are improved by using a magnetic antenna having overlapping multiple winding sets that are oriented to different directions.

Other advantages may be readily ascertainable by those skilled in the art.

BRIEF DESCRIPTION OF THE DRAWINGS

Reference is now made to the following description taken in conjunction with the accompanying drawings, wherein like reference numbers represent like parts, in which:

FIG. 4 illustrates a perspective view of one embodiment of a loop set that may serve as a passive low-pass filter shield of the magnetic antenna of FIG. 1; and FIG. 5 illustrates a flowchart of a method for intercepting signals using the magnetic antenna of FIG. 1.

DETAILED DESCRIPTION OF EXAMPLE EMBODIMENTS OF THE INVENTION

Embodiments of the invention are best understood by referring to FIGS. 1 through 5 of the drawings, like numerals being used for like and corresponding parts of the various drawings.

Figure 1:
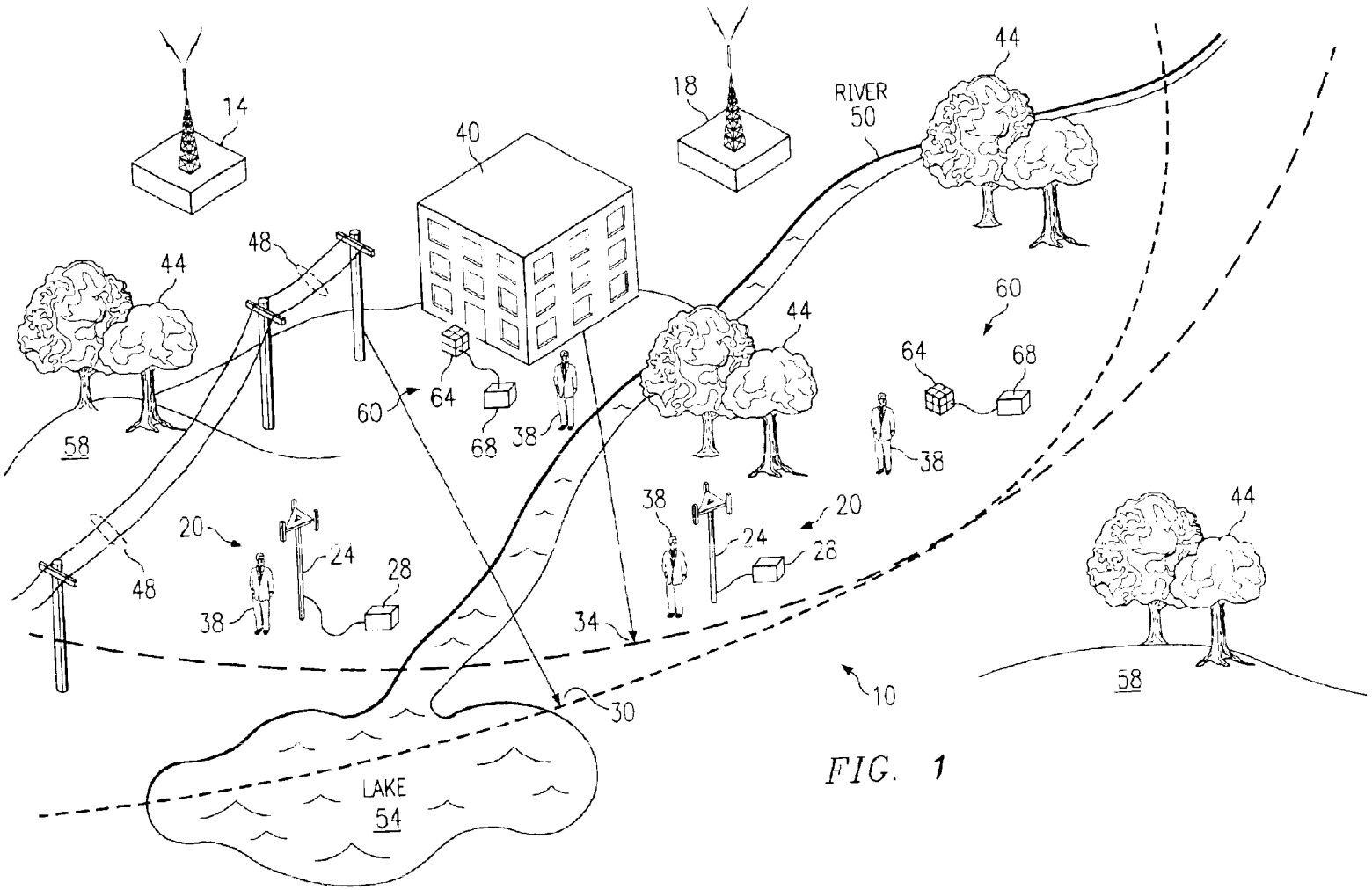
FIG. 1 illustrates a working environment for wireless communications including signal sources and signal detectors.

FIG. 1 illustrates a working environment 10 for one embodiment of the present invention. Working environment 10 includes one or more sources 14 and 18 of electromagnetic signals. Although FIG. 1 illustrates only two sources 14 and 18, any number of sources may be present within the scope of the present invention. Working environment 10 also comprises one or more signal detection systems 20. Each system 20 comprises an electric field antenna ("E-field antenna") 24 and a signal processing unit 28. Systems 20 may be positioned within the respective ranges (depicted by dotted lines 30 and 34) of sources 14 and 18. Systems 20 may be operable to conduct direction finding ("DF") operations. A DF operation refers to finding a direction to source 14 or 18 from system 20. Working environment 10 may also comprise various man-made and natural terrain features, such as a building 40, trees 44, power lines 48, a river 50, a lake 54, hills 58, or any other features that may affect the signal detection and DF capabilities of E-field antenna 24.

Several factors concerning terrain features 40 through 58 may be considered prior to positioning E-field antenna 24 at a particular location to conduct a signal detection operation. For example, locations near power emission sources, such as power lines 48, are generally avoided because power emission sources interfere with the signal reception of E-field antennas 24. Vegetation and bodies of water, such as trees 44, river 50 and lake 54, may adversely affect the DF capability of E-field antenna 24. The E-field antenna 24 that is placed near building 40 receives weaker signals because the material used to build building 40 may either attenuate or completely block out the signals from certain directions. Features that are not-visible, such as the percentage of metal or other conductive materials that are mixed into the ground, may adversely affect the ability of E-field antenna 24 to detect signals. Additionally, an E-field antenna 24 that is sensitive enough to detect signals from a tactically required distance may be too large for an operator 38 to provide effective camouflage or concealment. Because the placement of antenna 24 requires consideration of these and other concerns, the range of options for a planner who is positioning E-field antenna 24 may be limited.

According to one embodiment of the present invention, an apparatus and method are provided that allow a wider range of options for conducting signal detection operations by providing a magnetic antenna having multiple windings as a detection antenna. This is advantageous in some embodiments of the invention because a magnetic antenna having multiple windings is light, compact, sensitive, and allows an operator to position the antenna without regard to some of the terrain features that adversely affected the effectiveness of an E-field antenna. According to one embodiment, the signal sensitivity of a magnetic antenna is increased without increasing the antenna's size by providing multiple windings to form the magnetic antenna. According to another embodiment, the effectiveness of direction finding operations are improved by using a magnetic antenna having overlapping multiple winding sets, where each winding set is oriented to a different direction. Additional details of example embodiments of the invention are described in greater detail below in conjunction with some portions; of FIG. 1 and FIGS. 2A through 5.

Referring back to FIG. 1, a signal detection system 60 is positioned within the ranges depicted by dotted lines 30 and 34. System 60 comprises a magnetic antenna 64 having multiple parallel windings. In some embodiments, multiple sets of parallel windings are positioned substantially orthogonal to each other for improved DF operations. Antenna 64 is coupled to a signal processing unit 68 through a pre-amplifier (not explicitly shown) that is operable to convert signals from sources 14 and/or 18 into audio signals and analyze the received signals to determine a direction to sources 14 and/or 18, in some embodiments. Details of the pre-amplifier and signal processing unit 68 are not described because they are well known in the art. Using a magnetic antenna as a signal detection antenna is advantageous in some embodiments of the invention because magnetic antennas sense the magnetic portion of an electromagnetic signal, which is not affected by terrain features such as features 40 through 58. In one embodiment, the sensitivity of magnetic antenna 64 is increased without a significant increase in physical size by providing multiple parallel windings. Multiple windings allow an antenna to remain physically small while reducing source impedance for greater power transfer efficiency to the preamplifiers, which improves sensitivity of the antenna.

Figure 2A:
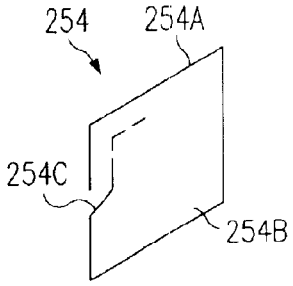
FIGS. 2A–2E illustrate additional details of one embodiment of a magnetic antenna of FIG. 1.

FIGS. 2A through 2E illustrate additional details of one embodiment of magnetic antenna 64 of FIG. 1. FIGS. 2A through 2E are described jointly. FIG. 2A illustrates one embodiment of a winding 254 that may be positioned around a body 120 (shown in FIG. 2B) to form a winding set of a magnetic antenna 64. Winding 254 may be formed from a wire 254A. In one embodiment, wire 254A may be an 18-gauge insulated copper wire; however, other types of wire formed from any conductive material may be used. One substantially complete turn of wire 254A forms one winding 254 that defines one plane 254B. Although FIG. 2A illustrates plane 254B that may have been defined by winding 254 positioned around a rectangular body, plane 254B may be in any shape. For example, where a sphere-shaped body is used, plane 254B may be circular; however, the shape of plane 254B is not necessarily dependent on the shape of the body. As shown in FIG. 2A, in some embodiments, wire 254A may not be wound to completely close on itself. In one embodiment, to form another winding, a portion 254C of wire 254A may be tilted at an angle before starting another winding. Tilted portions 254C of wire 254A allow multiple windings 254 to form corresponding planes 254B that are substantially flat and parallel to each other. One or more windings 254 that define corresponding one or more parallel planes 254B are referred to as a winding set. Additional details of a winding set is provided below in conjunction with FIGS. 2C through 3.

In one embodiment, one or more wires 254A that form a winding set oriented to a particular direction may be required to have a total length that is equal to one-tenth of the wavelength of the highest frequency that is to be received by antenna 64. For example, where 30 MHz is the highest frequency that is to be received by a winding set of antenna 64, the total length of one or more wires 254A that form the winding set is equal to or less than 1 meter. This is because 1 meter is one-tenth of 10 meters, which is the wavelength of a 30 MHz signal.

Figure 2B:
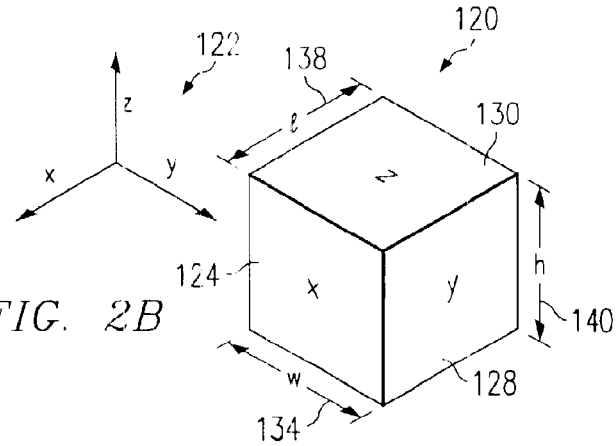

Referring to FIG. 2B, in one embodiment, body 120 comprises surfaces 124, 128, and 130 that face the x-direction, the y-direction, and the z-direction, respectively. The x-direction, the y-direction, and the z-direction are indicated by arrows 122. Body 120 may also be referred to as core 120. Body 120 has a width 134, a length 138, and a height 140. Although body 120 is shown as a solid have six rectangular surfaces, a body having any other shape, solid or otherwise, that allows at least one winding set to be placed around body 120 may be used. For example, a sphere shape or three cylinders that are joined and oriented along the x, y, and z directions, respectively, may be used as body 120. Body 120 may be formed from any suitable material for antenna applications. In one embodiment, body 120 is formed from a non-ferrous, non-conductive material, such as balsa wood. This is advantageous in some embodiments of the invention because such body 120 is not susceptible to the earth's gravitational fields, which could cause biasing offsets in DF operations.

In one embodiment, the physical dimensions of body 120 may vary depending on the required physical dimensions of windings 254 that are positioned around body 120. For example, it a greater level of sensitivity is required, body 120 may be larger in size to accommodate physically larger windings. In some embodiments where multiple winding sets are positioned substantially orthogonal to each other for improved DF capability, the physical dimensions of body 120 may be adjusted so that the planes defined by certain winding, sets are equal in size. In one embodiment, body 120 has width 134 of 11.25 inches, length 138 of 10.5 inches, and height 140 of 10.5 inches, so that windings 254 that are formed by wrapping wire 254A around body 120 assume physical dimensions for intercepting signals in the frequency range of approximately 50 kHz to 32 MHz. Additionally, these dimensions of body 120, in conjunction with strategic use of 3/16 inch spacers (shown in FIGS. 2C through 2E), allow two of the three winding sets that are positioned substantially orthogonal to each other to define parallel planes 254B that are equal in size for optimized DF capability at a frequency range of 50 kHz to 32 MHz.

Figure 2C:
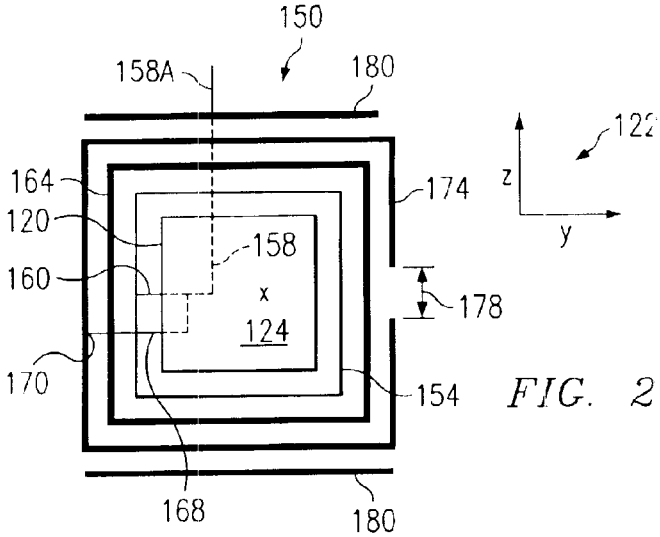

Referring to FIG. 2C, a winding set 154 is positioned around body 120. The one or more parallel planes defined by one or more windings, such as winding 254, of winding set 154 face the x-direction. Thus, winding set 154 may be said to be oriented to the x-direction. In one embodiment, a spacer 164 is positioned over winding set 154. An electrostatic shield 174 is positioned over spacer 164. Electrostatic shield 174 is wrapped around spacer 164 so that a gap 178 is defined. Gap 178 is defined so that electrostatic shield 174 does not form an electrically closed loop. In one embodiment, to adjust the physical dimensions for the next set of windings, two spacers 180 are positioned over, electrostatic shield 174; however, spacers 180 may not be necessary where the dimensions of body 120 are such that at least two winding sets positioned around body 120 may define parallel planes having a same area without spacers 180 or where antenna 64 is not required to have a plurality of winding sets that define parallel planes having a same area. In one embodiment, a cable 158, such as a twinax type cable, is inserted through body 120. One end of cable 158 is electrically coupled to winding set 154 at a junction 160. The other end of cable 158 is inserted through spacers 164, 180, and electrostatic shield 174 so that a cable lead 158A may be coupled to a signal processing unit through a connector, such as a triax type connector. In one embodiment, cable 158 is grounded by a line 168 that is electrically coupled to electrostatic shield 174 at junction 170. The assembly shown in FIG. 2C is referred to as an assembly 150.

Figure 2D:
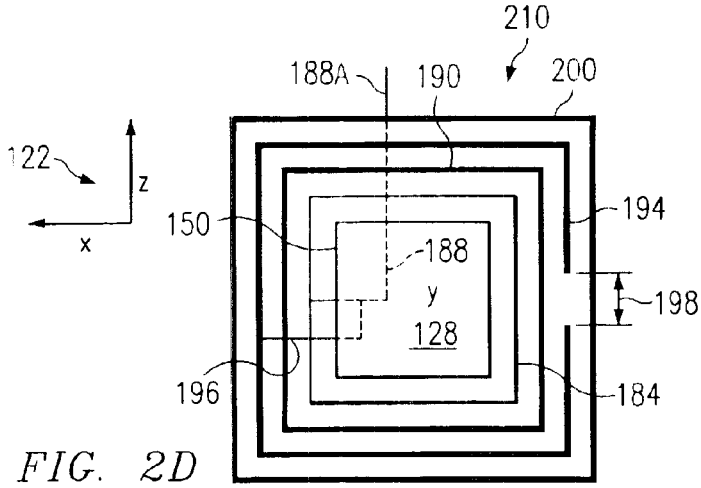

Referring to FIG. 2D, in one embodiment, a winding set 184 is positioned around assembly 150. In one embodiment, winding set 184 is oriented to the y-direction because the parallel planes defined by the windings, such as winding 254, of winding set 184 face the y-direction. As such, winding set 184 is positioned substantially orthogonal to winding set 154, which is oriented to the x-direction. In one embodiment, "substantially orthogonal" refers to winding sets that are within a tolerance level of +/− three degrees from being perpendicular to each other; however, other tolerance levels may be acceptable depending on the particular design specifications of antenna 64. In one embodiment, the number of windings of winding set 184 is equal to the number of windings of winding set 154. In one embodiment, each plane, such as plane 254B, defined by winding set 184 has the same area as the corresponding planes defined by winding set 154.

In one embodiment, spacer 190 is positioned over winding set 184. An electrostatic shield 194 is positioned over spacer 190. A gap 198 is defined by electrostatic shield 194 so that electrostatic shield 194 does not form an electrically closed loop. In one embodiment, a spacer 200 is positioned over electrostatic shield 194. A cable 188, such as a twinax type cable, is inserted through body 120 so that one end of cable 188 may be electrically coupled to winding set 184. The other end of cable 188 is routed through spacer 180, winding set 184, spacer 190, electrostatic shield 194, and spacer 200 so that a cable lead 188A may be coupled to a signal processing unit through a connector, such as a triax connector. In one embodiment, cable 188 is grounded by a line 196 that electrically couples cable 188 to electrostatic shield 194. The assembly shown in FIG. 2D is referred to as an assembly 210.

Figure 2E:
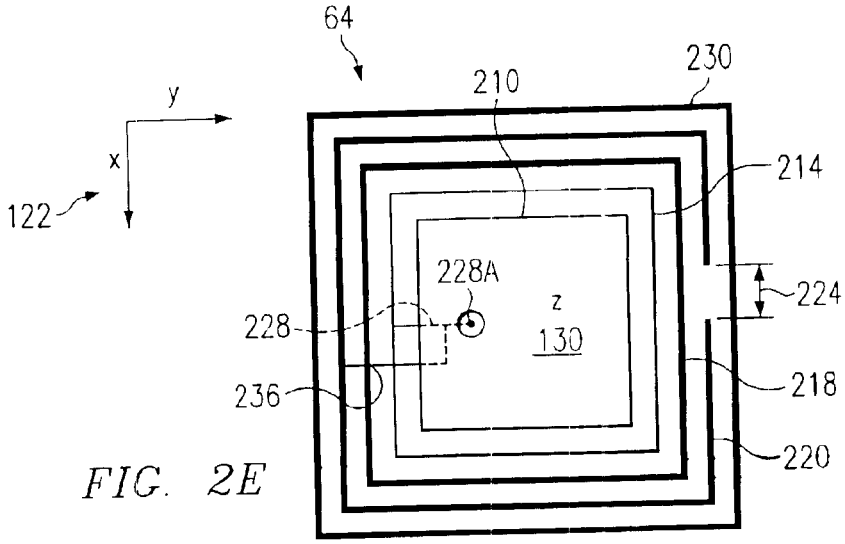

Referring to FIG. 2E, in one embodiment, a winding set 214 is positioned over assembly 210. In one embodiment, winding set 214 is oriented to the z-direction, which makes winding set 214 substantially orthogonal to both winding sets 154 and 184. Magnetic antenna 64 having winding sets 154, 184, and 214 has three orthogonal directions from which signals are received. This is advantageous in some embodiments of the invention because receiving signals from multiple directions enhances the accuracy of DF operations. In one embodiment, a spacer 218 is positioned over winding set 214. An electrostatic shield that defines a gap 224 is positioned over spacer 218. In one embodiment, a spacer 230 is positioned over electrostatic shield 220. A cable 228 is inserted through body 120 so that one end of cable 228 is electrically coupled to winding set 214. Cable 228 is inserted through winding set 214, spacer 218, electrostatic shield 220, and spacer 230 so that a cable lead 228A may be coupled to a signal processing unit through a connector, such as a triax connector. In one embodiment, cable 228 is grounded by a line 236 that electrically couples cable 228 to electrostatic shield 220.

Referring back to FIGS. 2C through 2E, in one embodiment, spacers 164, 180, 190, 200, 218, and 230 may, be formed from any non-conductive material, such as foam boards. In one embodiment where body 120 has width 134 of 11.25 inches, length 138 of 10.5 inches, and height 140 of 10.5 inches, each one of spacers 164, 180, 190, 200, 218, and 230 is 3⁄16 inch thick so that windings 254 that are formed by wrapping wires, such as wire 254A, around body 120 assume the appropriate physical dimensions for detecting signals in the range of approximately 50 kHz to 32 MHz. Additionally, the thickness (3⁄16 inch) of spacers 164, 180, 190, 200, and 218 operate in conjunction with these dimensions of body 120 to allow winding sets 154 and 184 to define parallel planes that are equal in size for optimized DF capabilities. Spacers 164, 180, 190, 200, 218, and 230 may have different physical dimensions depending on the design specifications of antenna 64, as determined by one skilled in the art. In some embodiments, more or less spacers may be needed to yield suitable winding dimensions. Electrostatic shields 174, 194, and 220 may be formed from any thin layer of non-magnetic, conductive material, such as copper or aluminum foil. In some embodiments, gaps 178, 198, and 224 may be approximately ¼ inch wide.

Figure 3:
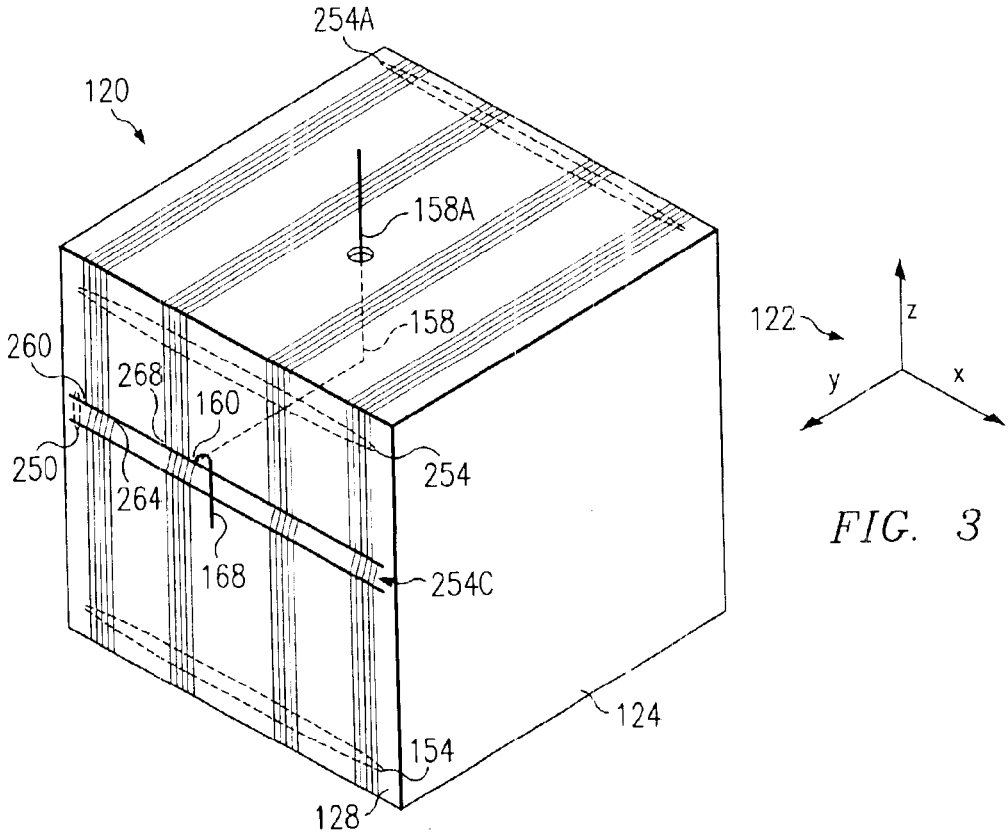
FIG. 3 illustrates a perspective view of one embodiment of a winding set of the magnetic antenna of FIG. 1.

FIG. 3 illustrates a perspective view of one embodiment of winding set 154 shown in FIG. 2B. In one embodiment, winding sets 184 and 214 may be structurally analogous to the embodiment of winding set 154 shown in FIG. 3. As shown in FIG. 3, winding set 154 comprises a plurality of windings 254 that are formed from one or more wires, such as wire 254A. In one embodiment, there are seven groups of five windings 254A in winding set 154; however, other number of windings may be included in winding set 154, depending on the particular winding strategy of the particular design of antenna 64. In one embodiment, body 120 comprises bus bars 250. Bus bars 250 may be formed from any conductive material, such as copper. In one embodiment, bus bars 250 are formed from non-ferrous material. Bus bars 250 may be attached to body 120 to provide a location where wire 254A that is wound around body 120 may be tilted between each winding 254. Tilting some portions 254C of wire 254A allows windings 254 to be parallel to each other. In one embodiment, bus bars 250 may also be used to electrically couple the plurality of windings 254. As shown in FIG. 3, one end of wire 254A may be soldered onto one of bus bars 250 at a junction 260. After one turn is substantially complete, wire 254A comes back to bus bars 250. To start a next winding 254, wire 254A is tilted at portion 254C, as shown in FIG. 3. After a suitable number of windings 254 are formed, the other end of wire 254A is soldered to a junction 264 of bus bars 250. Then, in one embodiment, a second wire 254A may start another group of windings 254 at another junction 268 of bus bars 250. This process may be repeated until a desired number of windings 254 are provided for winding set 154. In one embodiment, as shown in FIG. 3, cable 158 may be coupled to winding set 154 through bus bars 250 at junction 160. In one embodiment, portions 254C of wire 254A are tilted at a uniform angle, depending on the design specifications of antenna 64.

FIG. 4 illustrates a perspective view of one embodiment of a loop set 300 that may be used in conjunction with some embodiments of antenna 64. In one embodiment, loop set 300 functions as a passive low-pass filter shield to provide a gentle passive roll-off of the frequency response for the highest frequency of the frequency range for which antenna 64 is designed. By measuring the inductance of windings 254 in a particular winding set and having a known resistance, the frequency roll-off point may be determined by the following equation:

$$F = \frac{R}{(2 * \pi * L)}$$

where

F=Frequency roll-off point

R=Total resistance

L=Measured inductance.

By generating a counter-magnetic field using the resistors 308, a gentle roll-off is allowed when high frequency signals that are out of the band frequency range are received.

As shown in FIG. 4, loop set 300 is oriented to the z-direction; however, in other embodiments, other loop sets oriented to different orthogonal directions, such as the x and y directions, may also be positioned over winding sets 154, 184, and 214. In one embodiment, each one of winding sets 154, 184, and 214 may have a corresponding loop set, such as loop set 300, that overlies the particular winding set and oriented to the same direction as the particular winding set. In one embodiment, loop set 300 comprises at least one loop 304 that is electrically closed by at least one resistor 308. In one embodiment, a plurality of loops 304 may be formed using bus bars 320. Bus bars 320 are coupled to each other by one or more resistors 308. Loops 304 may be formed from any insulated conductive material, such as ¼ inch copper tape. In one embodiment, loops 304 of loop set 300 may be evenly spaced. In one embodiment, loop set 300 designed for a gentle passive roll-off of the frequency response for 35 MHz or above may comprise five parallel loops 304 of ¼ inch copper tape and connected by five 820 ohm resistors 308.

FIG. 5 illustrates a flowchart of a method 350 for signal detection. Method 350 starts at step 354. At step 358, a magnetic DF antenna, such as antenna 64, is provided. At step 360, a signal processing unit is coupled to DF antenna 64. At step 364, a signal is received from a source, such as source 14, using antenna 64. At step 368, received signals are converted using signal processing unit into audio signals. At step 370, the receive signals are analyzed using signal processing unit 84 to find a direction to signal source 14. In one embodiment, as shown in FIG. 5, steps 368 and 370 may be performed simultaneously; however, in some embodiments, step 368 may be performed before or after performing step 370. Method 350 concludes at step 374.

Although some embodiments of the present invention have been described in detail, it should be understood that various changes, substitutions, and alterations can be made hereto without departing from the spirit and scope of the invention as defined by the appended claims.

What is claimed is:

1. A signal receiving apparatus, comprising:

a core having six substantially rectangular sides and formed from a non-ferrous, non-conductive material;

three winding sets formed from three corresponding wire sets that are wound around the core, the three winding sets positioned orthogonal to each other and separated at least in part from each other by one or more spacers, each of the three corresponding wire sets comprising at least one wire;

wherein each one of the three winding sets comprises two or more substantially rectangular windings electrically coupled to each other and substantially defining a corresponding two or more substantially rectangular planes, the corresponding two or more substantially rectangular planes substantially parallel to each other;

two or more electrostatic shields separating the three winding sets from each other; and wherein, for at least two of the three winding sets, the substantially rectangular planes defined by the substantially rectangular windings are equal in size, and the respective numbers of windings for each of the at least two of the three winding sets are substantially the same.

2. The apparatus of claim 1, wherein a total length of the at least one wire is substantially equal to one tenth of a wavelength of a highest frequency signal receivable by the signal receiving apparatus.

3. The apparatus of claim 1, wherein the core comprises a physical dimension of approximately 10.5 inches in width, approximately 10.5 inches in length, and approximately 11.25 inches in height.

4. The apparatus of claim 1, and further comprising:

three loop sets positioned around the core, the three loop sets substantially orthogonal to each other and overlying the three winding sets, wherein each one of the three loop sets comprises at least one loop formed from a conductive material that is electrically closed by a resister, the each one of the three loop sets corresponding to a particular one of the three winding sets and having a same directional orientation as the particular one of the three winding sets.

5. A signal receiving apparatus, comprising:

a body;

a plurality of winding sets positioned substantially orthogonal to each other and around the body;

wherein each one of the winding sets comprises two or more windings electrically coupled to each other and substantially defining a corresponding two or more planes, the corresponding two or more planes substantially parallel to each other; and wherein for at least two of the plurality of winding sets, the planes defined by the windings are substantially equal in size.

6. The apparatus of claim 5, wherein the number of windings for each of the at least two of the plurality of winding sets is substantially the same.

7. The apparatus of claim 5, and further comprising a plurality of electrostatic shields that at least partly separate the plurality of winding sets from each other.

8. The apparatus of claim 5, wherein the plurality of winding sets comprises only three winding sets, and for at least two of the plurality of winding sets, the planes defined by the windings face two separate horizontal directions and are substantially equal in size, and the respective numbers of windings for each of the at least two of the plurality of winding sets are substantially the same.

9. The apparatus of claim 5, wherein the body is formed from a non-ferrous, non-conductive material.

10. The apparatus of claim 5, and further comprising:

at least one loop set positioned around the body, the at least one loop set overlying the at least one winding set, wherein each one of the at least one loop set comprises one or more loops that are formed from a conductive material and electrically closed by at least one resister, the each one of the at least one loop set corresponding to a particular one of the at least one winding set and having a same directional orientation as the particular one of the at least one winding set.

11. The apparatus of claim 5, and further comprising a signal processing unit electrically coupled to the at least one winding set, the signal processing unit operable to convert one or more signals received by the at least one winding set into corresponding one or more audio signals and to approximate a direction to a source of the received one or more signals by analyzing the one or more signals.

12. The apparatus of claim 5, wherein the body further comprises a bus bar and each one of the two or more windings are formed from at least one wire that is wound around the body and the bus bar, and wherein some portions of the at least one wire that separates the two or more windings are tilted at the bus bar at a substantially similar angle.

13. The apparatus of claim 5, wherein the body is a non-ferrous, non-conductive core having six substantially rectangular sides.

14. The apparatus of claim 5, wherein the body is a three dimensional structure having a length and a width, the length longer than the width.

15. The apparatus of claim 5, wherein the windings of each winding set are grouped into a plurality of winding groups, each winding group separated from another winding group by a first gap, the windings in each winding group separated from each other by a second gap that is smaller than the first gap, and wherein all of the planes in the each winding set are parallel to each other.

16. A method for locating a source of a signal, comprising:

providing an antenna system comprising:

a plurality of winding sets that are substantially orthogonal to each other;

wherein each one of the plurality of winding sets comprises two or more windings electrically coupled to each other and substantially defining a corresponding two or more planes, the corresponding two or more planes substantially parallel to each other;

receiving one or more signals that are transmitted from a source using at least one of the plurality of winding sets of the antenna system; and approximating a direction to the source by analyzing the one or more signals.

17. The method of claim 16, wherein, for at least two of the plurality of winding sets, the planes defined by the windings are substantially equal in size and the respective numbers of windings for each of the at least two of the plurality of winding sets are substantially the same.

18. The method of claim 16, and further comprising providing a plurality of electrostatic shields that at least partly separate the plurality of winding sets from each other.

19. The method of claim 16, wherein the plurality of winding sets are wound around a core formed from a non-ferrous, non-conductive material.

20. The method of claim 16, and further comprising:

providing a plurality of loop sets overlying the plurality of winding sets, wherein each one of the plurality of loop sets comprises at least two loops that are electrically closed by at least one resister, the each one of the plurality of loop sets corresponding to a particular one of the plurality of winding sets and has a same directional orientation as the particular one of the plurality of winding sets.

21. The method of claim 16, and further comprising positioning the antenna system beneath a surface of a ground.

22. The method of claim 16, wherein the plurality of winding sets comprises at least three winding sets.

23. A signal receiving apparatus, comprising:

a body;

at least one winding set positioned around the body, wherein each one of the at least one winding set comprises two or more windings electrically coupled to each other and substantially defining a corresponding two or more planes, the corresponding two or more planes substantially parallel to each other; and at least one loop set positioned around the body, the at least one loop set overlying the at least one winding set, wherein each one of the at least one loop set comprises one or more loops that are formed from a conductive material and electrically closed by at least one resister, the each one of the at least one loop set corresponding to a particular one of the at least one winding set and having a same directional orientation as the particular one of the at least one winding set.

24. The apparatus of claim 23, wherein the body comprises a length and a width, the length longer than the width.

* * * * *

UNITED STATES PATENT AND TRADEMARK OFFICE

CERTIFICATE OF CORRECTION

PATENT NO. : 6,873,302 B1
DATED : March 29, 2005
INVENTOR(S) : Raphael Joseph Welsh It is certified that error appears in the above-identified patent and that said Letters Patent is hereby corrected as shown below:

Column 2,
Line 48, after “are”, delete “not-visible” and insert -- not visible --.

Column 3,
Line 19, after “portions”, delete “;”.
Line 33, after “the”, delete “preamplifiers” and insert -- pre-amplifiers --.
Line 60, after “set”, delete “is” and insert -- are --.

Column 4,
Line 11, after “solid”, delete “have” and insert -- having --.
Line 27, before “a”, delete “it” and insert -- if --.
Line 33, after “winding”, delete “,”.
Line 56, after “over”, delete “,”.

Column 5,
Line 61, after “may”, delete “,”.

Signed and Sealed this

Twenty-first Day of February, 2006

JON W. DUDAS
*Director of the United States Patent and Trademark Office*